US007350835B1

(12) United States Patent
Smith

(10) Patent No.: US 7,350,835 B1
(45) Date of Patent: Apr. 1, 2008

(54) GATE LOCKING ASSEMBLY

(76) Inventor: Perry Smith, 81 Mulberry St., Careret, NJ (US) 07008

( * ) Notice: Subject to any disclaimer, the term of this patent is extended or adjusted under 35 U.S.C. 154(b) by 0 days.

(21) Appl. No.: 11/649,489

(22) Filed: Jan. 4, 2007

Related U.S. Application Data

(60) Provisional application No. 60/763,059, filed on Jan. 30, 2006.

(51) Int. Cl.
*E05B 39/02* (2006.01)
*E05C 1/04* (2006.01)

(52) U.S. Cl. ..... 292/148; 292/148; 292/150; 292/205

(58) Field of Classification Search ..... 16/412, 16/413, 427; 292/148, 137, 143, 150, 288, 292/289–296, 338, 339, DIG. 15, DIG. 24, 292/205, DIG. 27; 49/394; 256/73; 70/14, 70/93, 94, 101, 125, 129
See application file for complete search history.

(56) References Cited

U.S. PATENT DOCUMENTS 854,193 A * 5/1907 Betts ..... 292/189
1,723,007 A * 8/1929 Bittorf ..... 292/57
3,174,314 A 3/1965 Johnson
3,280,606 A * 10/1966 Howard et. al. ..... 292/259 R
3,451,703 A 6/1969 Roegner
3,906,760 A * 9/1975 Parker, Jr. ..... 70/154
4,545,150 A * 10/1985 Williams ..... 49/366
4,790,578 A 12/1988 Barrera
5,711,555 A * 1/1998 Leedy ..... 292/202
5,868,015 A * 2/1999 Eaker ..... 70/129
6,739,093 B1 * 5/2004 Holbert ..... 49/394

* cited by examiner

*Primary Examiner*—Patricia Engle
*Assistant Examiner*—Alyson M. Merlino

(57) ABSTRACT

A gate locking assembly includes an anchor shaft that has rectilinear-shaped first and second sections orthogonally registered with each other. The first section travels horizontally along a linear plane and the second section is disposed vertically and travels adjacent to a vertical frame portion of an existing gate. A rectilinear tubular rod has an axial bore formed therein and a proximal end positioned about the first section of the anchor shaft. The rod has a distal end provided with a pair of apertures formed in an outer surface thereof, and lays contiguously against the gate. A bracket is coupled to the vertical frame portion of the gate and has a sleeve oriented along a longitudinal length of the vertical frame portion. A lock is attached to the rod and channeled through the passageway.

15 Claims, 4 Drawing Sheets

GATE LOCKING ASSEMBLY

CROSS REFERENCE TO RELATED APPLICATIONS

This application claims the benefit of U.S. Provisional Application No. 60/763,059, filed Jan. 30, 2006.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to locking devices and, more particularly, to a gate locking assembly for allowing a user to maintain a gate at a locked position without employing a chain.

2. Prior Art

Chain link fences are well known. Typically such fences are made of a support frame of pipe which supports a mesh of thick metal wire which forms a screen. The screen is secured to the frame by pieces of wire which surround the frame work and mesh at fixed intervals. To provide a gate in an opening formed by pipe and/or poles of a chain link fence, a pipe frame the size of the opening is hinged to a pipe on one side of the opening. Typically, an oar lock or fork latch is hingeably attached to the opposite side of the gate frame. When the gate is in the closed position, the oar lock or fork latch is moved to the horizontal position where it receives a pole of the fence in the U-shaped portion thereof.

Typically, to lock the gate, openings are provided in the oar lock and the collar holding the oar lock to the gate. When the oar lock is in the closed position, i.e. horizontal, the openings in the lock and collar line up and a padlock is passed through the openings to lock them in their aligned position. With the lock in place, the oar lock cannot be moved from the horizontal closed position to the vertical open position. Thus the gate is locked.

One prior art example shows a gate latch for a chain link fence comprising a collar for mounting on a first portion of a gate; an oar lock latch for pivotal mounting on a second portion of a gate, the oar lock having means formed thereon to lock the oar lock to the collar. A means is also provided which is formed on the collar for interfitting with the locking means and for enclosing a portion of the oar lock to lock the oar lock to the collar and inhibit access to the enclosed portions of the oar lock. Unfortunately, this prior art example is complicated to install, and requires the use of screws and tools which may necessitate employing a professional to install the invention, thus requiring an additional expense to the user beyond the purchase price of the invention itself.

Another prior art example shows a gate lock for locking a gate to a fence which comprises a first arm mounted on a fence post for rotational movement relative thereto and a second arm having a curved end portion adapted to extend around said gate post for locking the same. The arms are pivotally connected to permit movement of the second arm relative to the first arm between a position enclosing the gate post and a second position free of the gate post to permit opening of said gate. The arms are provided with openings which are aligned when the arms are in a locking position to receive a padlock or the like. This prior art example is not readily adaptable to chain link fences, and can be difficult to use for those with limited coordination.

Accordingly, a need remains for a gate locking assembly to overcome the above-noted shortcomings. The present invention satisfies such a need by providing an assembly that is simple and easy to use, is lightweight yet durable in design, and provides additional security to the gates of chain-link type fences. Such an assembly is invaluable by providing a user with a means to keep their property safe from intruders. The assembly effectively keeps unwanted visitors from accessing a user yard or pool, thus advantageously helping to prevent accidents and injuries. The present invention is inexpensive, and can be effectively used by professionals, businesses, and private citizens.

BRIEF SUMMARY OF THE INVENTION

In view of the foregoing background, it is therefore an object of the present invention to provide an assembly for locking a gate having a pair of swiveling doors that are spaced apart such that a conventional pad lock can not reach across the doors. These and other objects, features, and advantages of the invention are provided by a gate locking assembly for allowing a user to maintain a gate at a locked position without employing a chain.

The assembly includes an L-shaped anchor shaft that has rectilinear-shaped first and second monolithically formed sections orthogonally registered with each other. Such a first section conveniently travels horizontally along a linear plane elevated from a ground surface. Such a second section is disposed vertically and conveniently travels contiguously adjacent to a vertical frame portion of an existing gate, and is removably interfitted below the ground surface.

The assembly further includes a rectilinear tubular rod that has an axial bore formed therein, such that the bore extends along an entire longitudinal length of the rod. Such a rod conveniently has a proximal end telescopically positioned about the first section of the anchor shaft, such that the rod lays coplanar with the first section of the shaft. Such a rod has a distal end provided with a pair of diametrically opposed apertures formed in an outer surface thereof, such that the apertures effectively define a continuous passageway through the distal end of the rod. Such apertures are oppositely spaced from the first section of the shaft, which is vital such that a lock can be effectively inserted through the apertures during operating conditions.

The rod lies contiguously against the gate and is conveniently oriented orthogonal to the vertical frame portion of the gate. The first section and the rod have a combined longitudinal length advantageously traversing across the vertical frame portion of the gate such that the gate is effectively prohibited from being swiveled to an open position during operating conditions. The rod and the shaft advantageously remain directly coupled to each other while the gate is adapted to a closed position, which is essential for preventing unauthorized access through the gate. The rod conveniently has a longitudinal length shorter than a longitudinal length of the second section of the shaft.

The assembly further includes a bracket directly coupled to the vertical frame portion of the gate. Such a bracket has a tubular sleeve vertically oriented along a longitudinal length of the vertical frame portion so that the second section of the shaft is effectively passed through the sleeve such that the second section advantageously maintains a fixed spatial relationship with the vertical frame portion of the gate. The assembly further includes a lock directly attached to the rod and directly channeled through the passageway such that the rod is effectively prevented from being displaced from the gate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
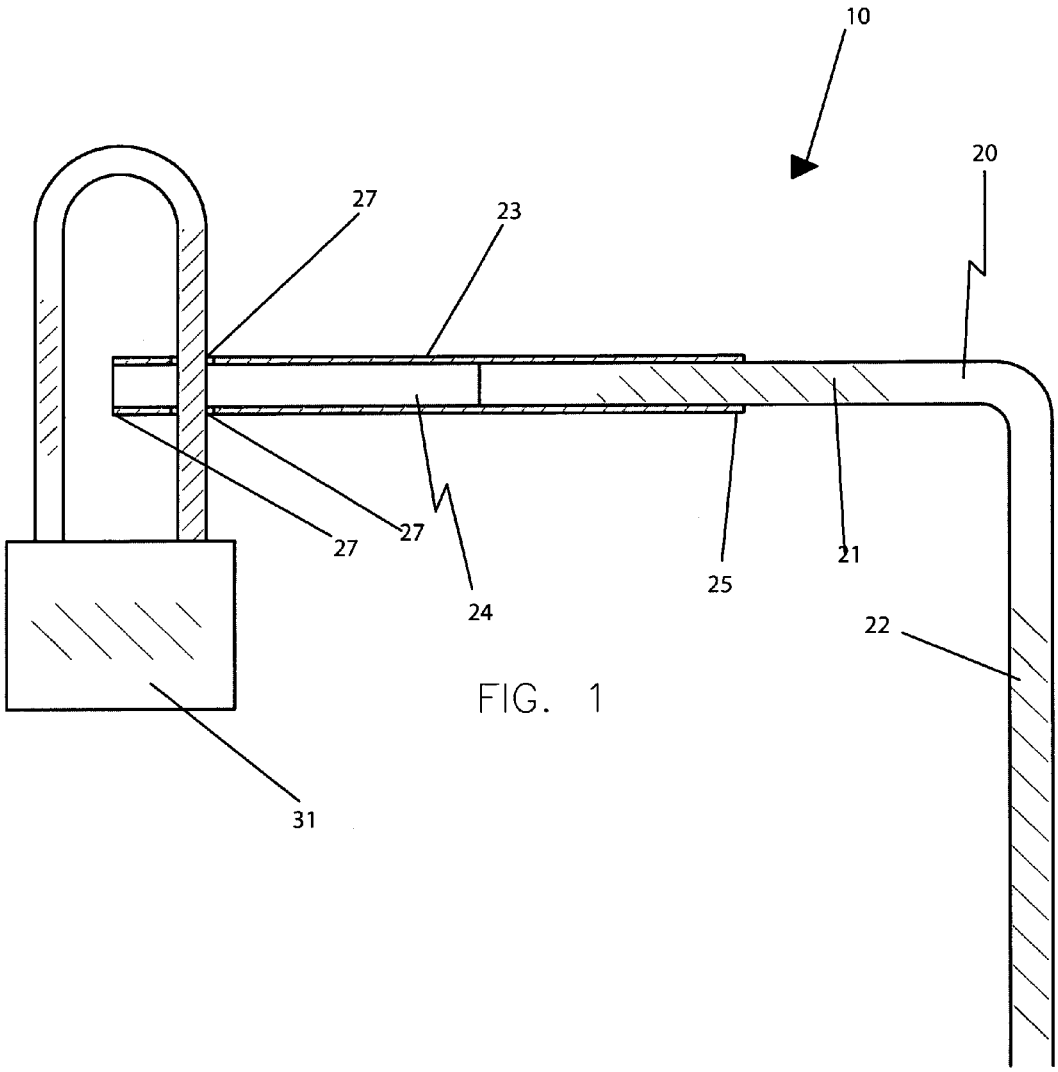
FIG. 1 is a front elevational view of a gate locking assembly showing a cross sectional view of the rod, taken along line 1-1, in accordance with the present invention.
Figure 2:
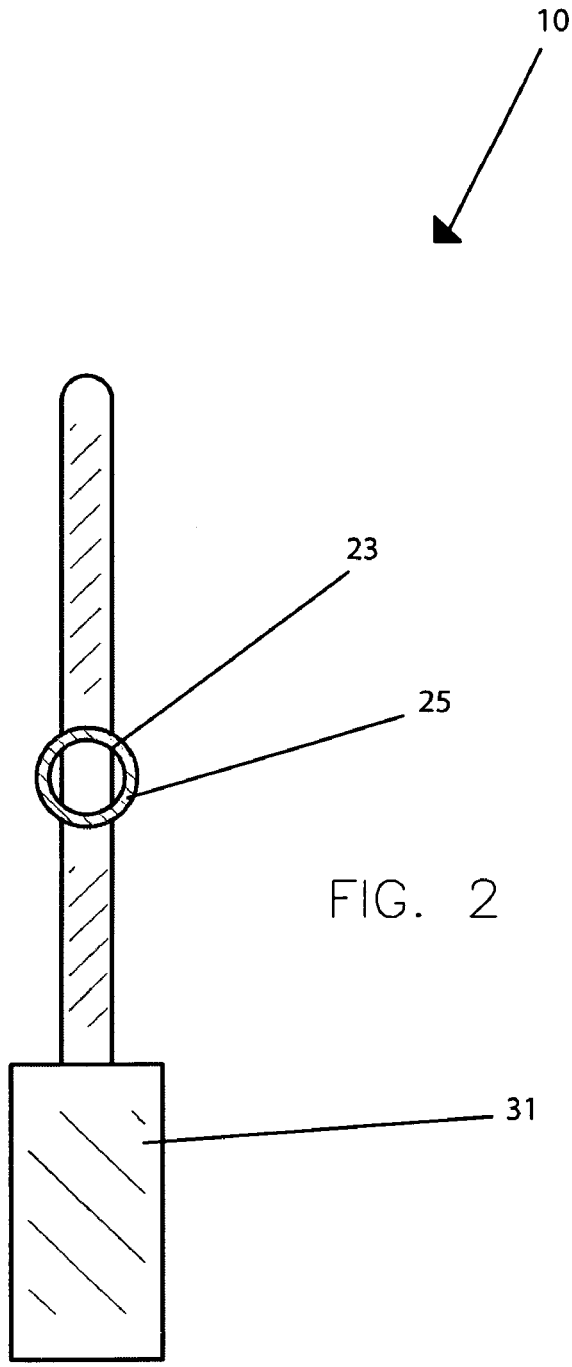
FIG. 2 is a side elevational view of the rod and the lock shown in FIG. 1 viewed from the proximal end of the rod.
Figure 3:
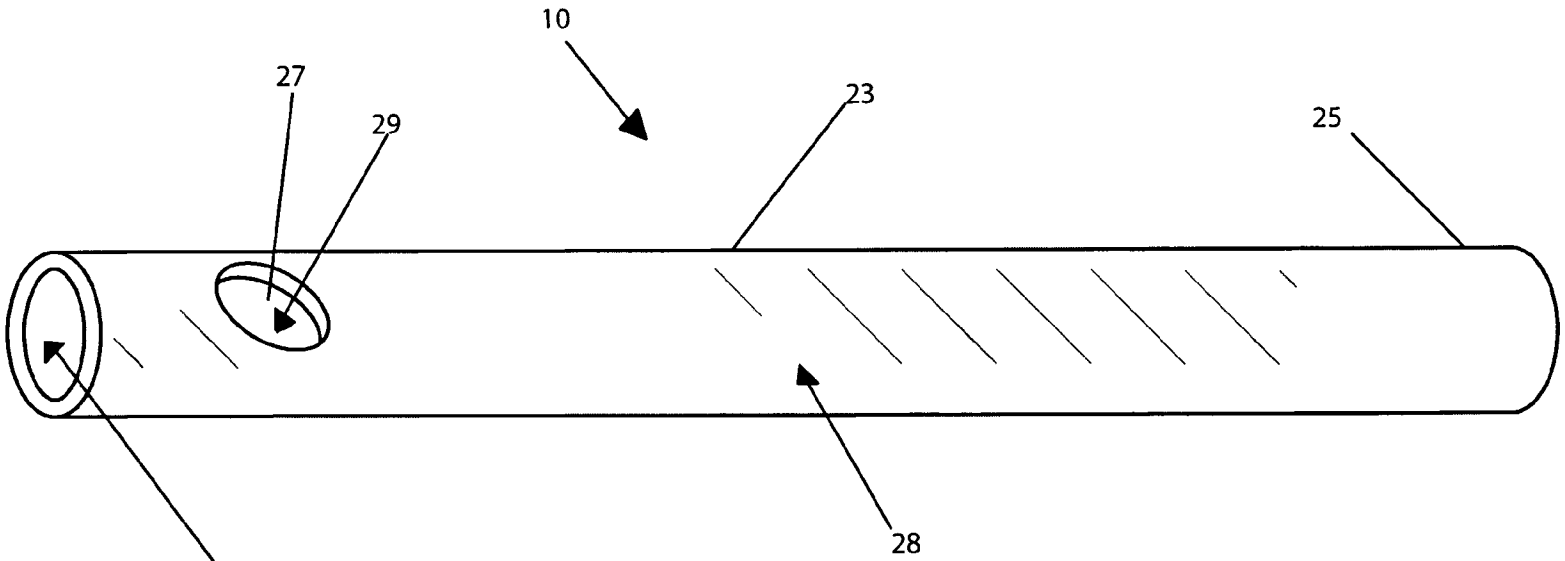
FIG. 3 is a perspective view of the rod.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-4 by the reference numeral 10 and is intended to provide a gate locking assembly. It should be understood that the assembly 10 may be used to secure many different types of gates and should not be limited in use to securing only those gates described herein.

Figure 4:
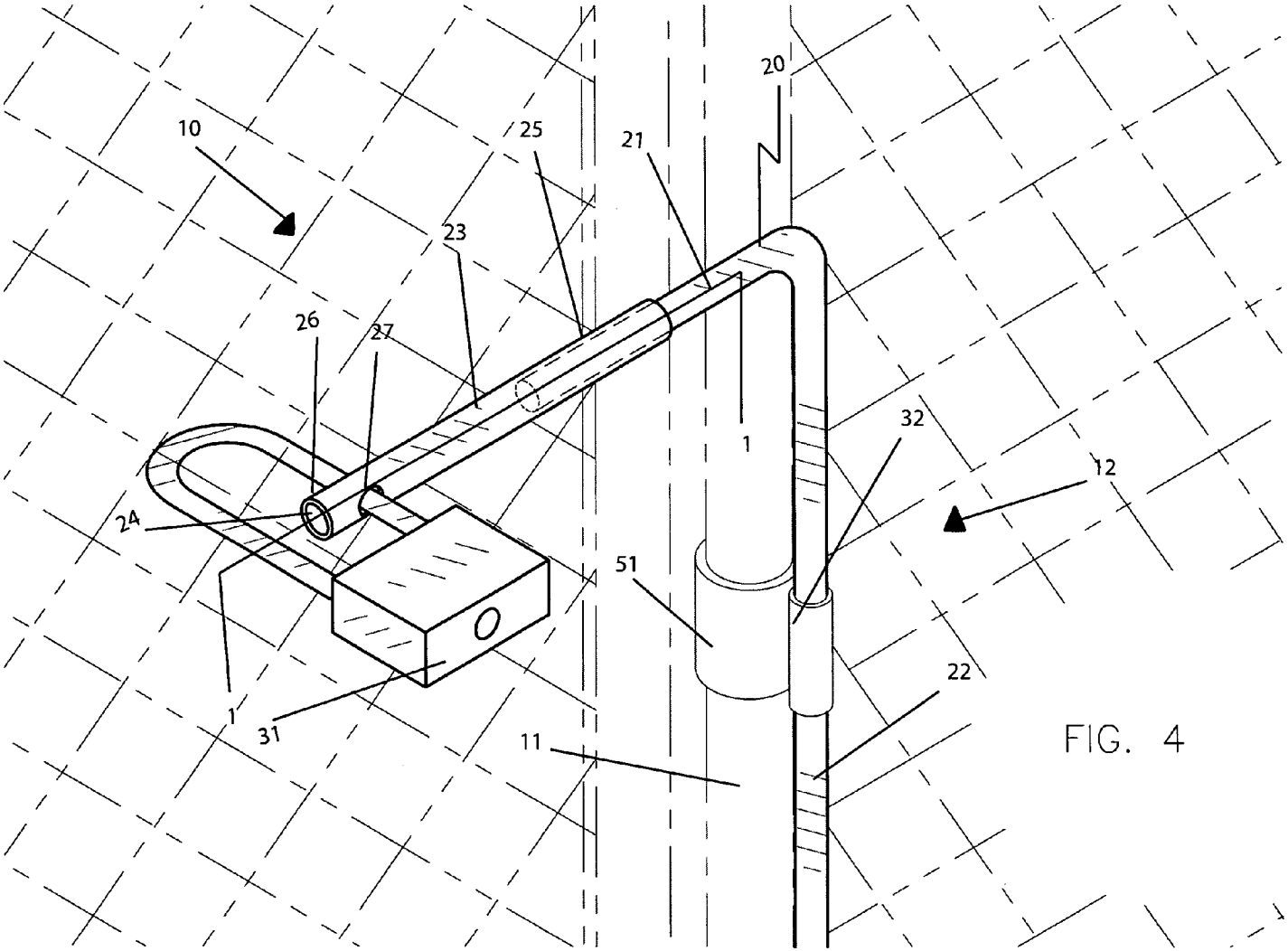
FIG. 4 is a perspective view of the assembly shown in FIG. 1 showing the assembly attached to a gate and in a locked position.

Referring initially to FIGS. 1 and 4, the assembly 10 includes an L-shaped anchor shaft 20 that has rectilinear-shaped first 21 and second 22 monolithically formed sections orthogonally registered with each other. Such a first section 21 critically travels horizontally along a linear plane elevated from a ground surface. Such a second section 22 is disposed vertically and critically travels contiguously adjacent to a vertical frame portion 11 of an existing gate 12, and is removably interfitted below the ground surface. Of course, such sections 21, 22 can be formed from a variety of suitably hardened materials, as is obvious to a person of ordinary skill in the art. It is essential that such sections 21, 22 travel orthogonal to each other for overcoming prior art shortcomings of not securely maintaining the doors of the gate at a closed position unless a chain is employed.

Referring to FIGS. 1, 2, 3 and 4, the assembly 10 further includes a rectilinear tubular rod 23 that has an axial bore 24 formed therein, such that the bore 24 advantageously extends along an entire longitudinal length of the rod 23. Such a rod 23 conveniently has a proximal end 25 telescopically positioned about the first section 21 of the anchor shaft 20, which is critical such that the rod 23 lays coplanar with the first section 21 of the shaft 20. Such a rod 23 has a distal end 26 critically provided with a pair of diametrically opposed apertures 27 formed in an outer surface 28 thereof, which is crucial such that the apertures 27 effectively define a continuous passageway 29 through the distal end 26 of the rod 23.

Such apertures 27 are oppositely spaced from the first section 21 of the shaft 20, which is vital such that a lock 31 can be effectively inserted through the apertures 27 during operating conditions. Of course, such apertures 27 can be formed in a variety of sizes and shapes, as is obvious to a person of ordinary skill in the art. Such an association of the rod 23 and the shaft 20 allows the rod 23 and shaft 20 to be effectively secured to a gate 12 simultaneously, thus providing an unexpected benefit that overcomes prior art shortcomings of requiring a cumbersome and heavy linked chain to mate with a pad lock, for example. It is noted that the rod 23 may include additional apertures spaced along the length thereof for accommodating various sized gates doors that have alternate spatial relationships therebetween.

Referring to FIG. 4, the rod 23 lies contiguously against the gate 12 and is conveniently oriented orthogonal to the vertical frame portion 11 of the gate 12. The first section 21 of the shaft and the rod 23 have a combined longitudinal length necessarily traversing across the vertical frame portion 11 of the gate 12, which is essential such that the gate 12 is effectively prohibited from being swiveled to an open position during operating conditions. The rod 23 and the shaft 20 advantageously remain directly coupled to each other, without the use of intervening elements, while the gate 12 is adapted to a closed position, which is essential for preventing unauthorized access through the gate 12 without employing a linked chain. The rod 23 conveniently has a longitudinal length shorter than a longitudinal length of the second section 22 of the shaft 20. Of course, such a rod 23 and shaft 20 can be produced in a variety of sizes, as is obvious to a person of ordinary skill in the art, so long as the ratio of the rod's length is shorter than the second 22 section's length.

Again Referring to FIG. 4, the assembly 10 further includes a bracket 51 directly coupled to the vertical frame portion 11 of the gate 12, without the use of intervening elements. Such a bracket 51 has a tubular sleeve 32 vertically oriented along a longitudinal length of the vertical frame portion 11 so that the second section 22 of the shaft 20 is effectively passed through the sleeve 32, which is critical such that the second section 22 advantageously maintains a fixed spatial relationship with the vertical frame portion 11 of the gate 12.

Yet again referring to FIG. 4, the assembly 10 further includes a lock 31 directly attached to the rod 23, without the use of intervening elements, and directly channeled through the passageway 29, without the use of intervening elements, which is crucial such that the rod 23 is effectively prevented from being displaced from the gate 12. Of course, such a lock 31 may be produced in a variety of sizes and strengths, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A gate locking assembly allowing a user to maintain a gate at a locked position without employing a chain, said gate locking assembly comprising:

an L-shaped anchor shaft having first and second monolithically formed sections orthogonally registered with each other, said first section traveling horizontally along a linear plane elevated from a ground surface, said second section being disposed vertically and traveling contiguously adjacent to a vertical frame portion of the existing gate, said second section being removably interfitted below ground surface;

a rectilinear tubular rod having an axial bore formed therein, said rod having a proximal end telescopically positioned about said first section of said anchor shaft, said rod having a distal end provided with a pair of diametrically opposed apertures formed in an outer surface thereof, said apertures defining a continuous passageway through said distal end of said rod, wherein said rod lays contiguously against the gate and is oriented orthogonal to the vertical frame portion of the gate;

a bracket directly coupled to the vertical frame portion of the gate, said bracket having a tubular sleeve vertically oriented along a longitudinal length of the vertical frame portion wherein said second section of said shaft is passed through said sleeve such that said second section maintains a fixed spatial relationship with the vertical frame portion of the gate; and a lock directly attached to said rod and directly channeled through said passageway such that said rod is prevented from being displaced from the gate;

wherein the bore extends along an entire longitudinal length of said rod.

2. The gate locking assembly of claim 1, wherein said rod and said shaft remain directly coupled to each other while the gate is adapted to a closed position.

3. The gate locking assembly of claim 1, wherein said rod lays coplanar with said first section of said shaft.

4. The gate locking assembly of claim 1, wherein said rod has a longitudinal length shorter than a longitudinal length of said second section of said shaft.

5. The gate locking assembly of claim 1, wherein said apertures are oppositely spaced from said first section of said shaft.

6. A gate locking assembly allowing a user to maintain a gate at a locked position without employing a chain, said gate locking assembly comprising:

an L-shaped anchor shaft having first and second monolithically formed sections orthogonally registered with each other, said first section traveling horizontally along a linear plane elevated from a ground surface, said second section being disposed vertically and traveling contiguously adjacent to a vertical frame portion of the existing gate, said second section being removably interfitted below ground surface;

a rectilinear tubular rod having an axial bore formed therein, said rod having a proximal end telescopically positioned about said first section of said anchor shaft, said rod having a distal end provided with a pair of diametrically opposed apertures formed in an outer surface thereof, said apertures defining a continuous passageway through said distal end of said rod, wherein said rod lays contiguously against the gate and is oriented orthogonal to the vertical frame portion of the gate, wherein said first section and said rod have a combined longitudinal length traversing across the vertical frame portion of the gate so that the gate is prohibited from being swiveled to an open position;

a bracket directly coupled to the vertical frame portion of the gate, said bracket having a tubular sleeve vertically oriented along a longitudinal length of the vertical frame portion wherein said second section of said shaft is passed through said sleeve such that said second section maintains a fixed spatial relationship with the vertical frame portion of the gate; and a lock directly attached to said rod and directly channeled through said passageway such that said rod is prevented from being displaced from the gate;

wherein the bore extends along an entire longitudinal length of said rod.

7. The gate locking assembly of claim 6, wherein said rod and said shaft remain directly coupled to each other while the gate is adapted to a closed position.

8. The gate locking assembly of claim 6, wherein said rod lays coplanar with said first section of said shaft.

9. The gate locking assembly of claim 6, wherein said rod has a longitudinal length shorter than a longitudinal length of said second section of said shaft.

10. The gate locking assembly of claim 6, wherein said apertures are oppositely spaced from said first section of said shaft.

11. A gate locking assembly allowing a user to maintain a gate at a locked position without employing a chain, said gate locking assembly comprising:

an L-shaped anchor shaft having first and second monolithically formed sections orthogonally registered with each other, said first section traveling horizontally along a linear plane elevated from a ground surface, said second section being disposed vertically and traveling contiguously adjacent to a vertical frame portion of the existing gate, said second section being removably interfitted below ground surface, wherein said first and second sections of said shaft have rectilinear shapes;

a rectilinear tubular rod having an axial bore formed therein, said rod having a proximal end telescopically positioned about said first section of said anchor shaft, said rod having a distal end provided with a pair of diametrically opposed apertures formed in an outer surface thereof, said apertures defining a continuous passageway through said distal end of said rod, wherein said rod lays contiguously against the gate and is oriented orthogonal to the vertical frame portion of the gate, wherein said first section and said rod have a combined longitudinal length traversing across the vertical frame portion of the gate so that the gate is prohibited from being swiveled to an open position;

a bracket directly coupled to the vertical frame portion of the gate, said bracket having a tubular sleeve vertically oriented along a longitudinal length of the vertical frame portion wherein said second section of said shaft is passed through said sleeve such that said second section maintains a fixed spatial relationship with the vertical frame portion of the gate; and a lock directly attached to said rod and directly channeled through said passageway such that said rod is prevented from being displaced from the gate;

wherein the bore extends along an entire longitudinal length of said rod.

12. The gate locking assembly of claim 11, wherein said rod and said shaft remain directly coupled to each other while the gate is adapted to a closed position.

13. The gate locking assembly of claim 11, wherein said rod lays coplanar with said first section of said shaft.

14. The gate locking assembly of claim 11, wherein said rod has a longitudinal length shorter than a longitudinal length of said second section of said shaft.

15. The gate locking assembly of claim 11, wherein said apertures are oppositely spaced from said first section of said shaft.

* * * * *